United States Patent [19]

Sato et al.

[11] Patent Number: 4,980,265

[45] Date of Patent: Dec. 25, 1990

[54] COLOR PHOTOSENSITIVE MATERIAL AND PROCESS FOR PRODUCING IMAGE USING SAME

[75] Inventors: Kozo Sato; Hiroyuki Hirai, both of Kanagawa, Japan

[73] Assignee: Fuji Photo Film Co., Ltd., Kanagawa, Japan

[21] Appl. No.: 394,794

[22] Filed: Aug. 17, 1989

[30] Foreign Application Priority Data

Aug. 19, 1988 [JP] Japan ..... 63-205931

[51] Int. Cl.[5] ..... G03C 5/54

[52] U.S. Cl. ..... 430/241; 430/222; 430/223; 430/224; 430/243; 430/213; 430/559

[58] Field of Search ..... 430/222, 223, 224, 559, 430/359, 241, 243

[56] References Cited

U.S. PATENT DOCUMENTS 3,980,479 9/1976 Fields et al. ..... 430/559
4,269,928 5/1981 Mason et al. ..... 430/223
4,339,523 7/1982 Psaila ..... 430/222

*Primary Examiner*—Richard L. Schilling
*Attorney, Agent, or Firm*—Sughrue, Mion, Zinn, Macpeak & Seas

[57] ABSTRACT

A color photosensitive material and a process for producing an image using such a material are disclosed. The color photosensitive material comprises a support having thereon a silver halide and a dye releasing compound represented by formula (A).

(A)

wherein Ar and Ar′, which may be the same or different, each represents an aromatic group or a heterocyclic group, Ar and Ar′ may be joined together to form a ring, and R represents an aromatic group, a heterocyclic group or a sulfonyl group.

9 Claims, No Drawings

COLOR PHOTOSENSITIVE MATERIAL AND PROCESS FOR PRODUCING IMAGE USING SAME

FIELD OF THE INVENTION

This invention concerns novel colored image forming compounds (dye releasing compound) with which dye images can be formed in inverse correspondence to the development of silver halide.

BACKGROUND OF THE INVENTION

There are various known methods for obtaining direct positive images by means of a diffusion transfer system. Thus, methods in which so-called direct action color materials, which are color materials with which a direct positive image is obtained, are used include methods in which dye developers are used, as disclosed, for example, in U.S. Pat. No. 2,983,606, and systems in which silver ion dye releasing agents (thiazolidine type color materials) are used, as disclosed, for example, in U.S. Pat. No. 4,468,451. Furthermore, system in which compounds which release diffusible dyes by means of an intramolecular nucleophilic substitution reaction under alkaline conditions are used have been disclosed, for example, in JP-A-51-63618 and JP-B-57-22099 (the terms "JP-A" and "JP-B" as used herein signify an "unexamined published Japanese patent application" and an "examined Japanese patent publication", respectively), and systems in which compounds which release diffusible dyes on reduction with a reducing agent which has not been consumed in the process of silver development are used have been disclosed, for example, in JP-A-53-110827 and JP-A-54-130927.

However, with all of these systems the development of silver halide and the dye releasing reaction occur at the same time, in parallel, and so there is a common disadvantage in that images with good discrimination cannot be obtained unless the rates of the two reactions are controlled very precisely.

On the other hand, methods of obtaining positive images using negative action color materials include systems in which a dye forming coupler is combined with dissolution type physical development as disclosed, for example, in British Pat. No. 1,330,524, and systems in which development inhibitor releasing couplers are used, as disclosed, for example, in JP-B-47-49611. However, with these systems the layer structure is complex since a mechanism by which the other silver salts in adjacent layers are developed in the unexposed parts, which is the parts where the development of silver halide does not proceed, is used, and control of the overall image forming reactions is inevitably very complicated.

In systems developed to overcome these problems, a negative type dye releasing agent is combined with a direct reversal emulsion, the dye releasing agent is oxidized in the unexposed parts, and a diffusible dye is released subsequently. Such systems have been described in detail in, for example, U.S. Pat. Nos. 3,928,312, 4,135,929 and 4,336,322. However, with this type of system a special reversal technique in which nucleating agents are combined with direct reversal emulsions is used and so these systems do not have general applicability. For example, as yet it has proved impossible to apply these techniques to systems in which development is carried out at a lower pH than that of the normal instant photographs or with dry heat development systems.

SUMMARY OF THE INVENTION

An object of the present invention is to provide color photosensitive materials with which images which have excellent discrimination can be obtained using a simple process and, particularly, it is intended to provide novel silver halide color photosensitive materials in which ordinary negative emulsions can be used and in which high quality positive images can be obtained using a simple layer structure.

The above and other objects of the present invention will be more apparent from the following description.

The above-mentioned objects have been realized by means of a color photosensitive material comprising a support having provided thereon a silver halide and an image forming (dye releasing) compound represented by formula (A):

$$\begin{array}{l} Ar-CH-Ar' \\ \quad\;\; | \\ \quad\;\; NH \\ \quad\;\; R \end{array} \qquad (A)$$

wherein Ar and Ar', which may be the same or different, each represents an aromatic group or a heterocyclic group, Ar and Ar' may be joined together to form a ring, and R represents an aromatic group, a heterocyclic group or a sulfonyl group. An image can be produced by image-wise exposing the above color photosensitive material, developing the material under alkaline conditions to cause oxidation of the dye releasing compound into structures which do not release a diffusible dye, and subsequently treating the developed material with an acidic compound to cleave the carbon-nitrogen bond of the dye releasing compound in regions where development has not taken place to cause release of diffusible dye, followed by image-wise transferring the diffusible dye to a dye fixing material.

DETAILED DESCRIPTION OF THE INVENTION

Ar and Ar' represent aromatic or heterocyclic groups. In this invention, the structure Ar—C+H—Ar' forms the basis of the diffusible dye and so Ar and Ar' must satisfy the conditions required for providing a yellow, magenta or cyan dye nucleus. One of the required conditions is that Ar and Ar' should be able to stabilize adequately the central carbonium ion. That is to say, Ar and Ar' must be powerful electron donating groups. Furthermore, a second requirement is that the cationic dye represented by Ar—C+H—Ar' should have excellent general characteristics (hue, fastness, molecular absorption coefficient, etc.) as a dye for image forming purposes, and it should also have good image transfer properties since it is to be used in a diffusion transfer photographic system.

Substituted or unsubstituted phenyl groups and naphthyl groups are examples of aromatic groups which satisfy these requirements. Actual examples of such groups include the phenyl, p-methoxyphenyl, 2,4-dimethoxyphenyl, p-dimethylaminophenyl, 2,5-dimethoxyphenyl, 2-methoxy-4-dimethylaminophenyl, 2-methyl-4-dimethylaminophenyl, 4-(N-methylanilino)phenyl and 4-dimethylamino-1-naphthyl groups. Of these groups, phenyl groups which have a di-substituted amino group in the p-position are especially preferred.

Substituted or unsubstituted nitrogen containing heterocyclic groups are preferred as heterocyclic groups. Actual examples of such groups include the 1,2-dimethyl-3-indolyl, 1-carboxymethyl-2-methyl-3-indolyl, 1,3,5-trimethyl-4-pyrazolyl and 1-phenyl-2,3-dimethylpyrazoline-5-one-4-yl groups. Of these groups, the substituted indolyl groups which are substituted in the 1-position are especially preferred.

Furthermore, examples of cases in which Ar and Ar' are joined together include cases in which they are joined with an oxygen atom to form a xanthene ring, cases in which they are joined with a nitrogen atom to form a dihydroacridine ring, and cases in which Ar and Ar' are linked directly to form a fluorene ring, and of these the cases in which xanthene rings and dihydroacridine rings are formed are especially preferred.

R represents an aromatic group, a heterocyclic group or a sulfonyl group. Substituted and unsubstituted phenyl groups and naphthyl groups are examples of aromatic groups. Actual examples include the phenyl, p-tolyll p-methoxyphenyl, p-dimethylaminophenyl, p-dodecyloxyphenyl, p-dioctylaminophenyl, aminophenyl, p-hydroxyphenyl, 3-hexadecyloxycarbamoyl-4-hydroxyphenyl, 3-(N-methyl-N-octadecylsulfamoyl)-4-hydroxyphenyl, 3-chloro-4-hydroxy-5-octadecanoylaminophenyl, 3-bromo-4-hydroxy-5-hexadecanoylaminophenyl, 2-methyl-4-N-methyl-N-octadecylamino)phenyl and 2-hydroxy-3-octadecylcarbamoyl-1-naphthyl groups. Substituted or unsubstituted nitrogen containing heterocyclic groups are preferred as heterocyclic groups, and examples of these groups include the 1-phenyl-2,3-dimethylpyrazolin-5-one-4-yl, 3-hexadecylbenzothiazolin-2-ylideneamino and 2-hexadecylcarbamoyl-3-indolyl groups, and the uses of any of these groups is desirable. Substituted and unsubstituted alkyl- or aryl-sulfonyl groups are examples of sulfonyl groups, and actual examples of such groups include the dodecylbenzenesulfonyl, 2-butoxy-5-tert-octylbenzenesulfonyl, 4-dodecyloxy-1-naphthylsulfonyl and hexadecylsulfonyl groups.

Among the actual examples of R, those which have ballast groups which have a total of at least 10 carbon atoms, more preferably at least 15 carbon atoms, and of which the NHR part forms a moiety which has the ability to reduce silver halide under alkaline conditions are especially preferred.

The group represented by NHR is preferably represented by one of formulae (I) to (VI) indicated below.

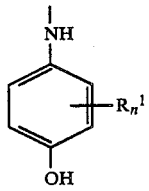

(I)

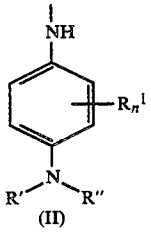

(II)

-continued

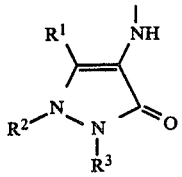

(III)

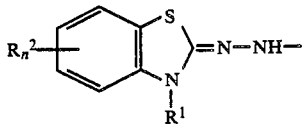

(IV)

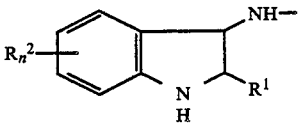

(V)

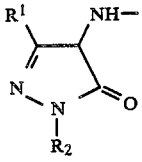

(VI)

In these formulae, R' and R'', which may be the same or different, each represents hydrogen atoms, alkyl groups, cycloalkyl groups, aralkyl groups and aryl groups, which groups may further be substituted; $R^1$, $R^2$ and $R^3$, which may be the same or different, each represents, for example, hydrogen atoms, hydroxy groups, halogen atoms, cyano groups, or substituted or unsubstituted alkyl groups, alkoxy groups, carbamoyl groups, sulfamoyl groups, acylamino groups, sulfonylamino groups, urethare groups, ureido groups, amino groups, acyl groups, sulfonyl groups, aralkyl groups, cycloalkyl groups, aryl groups or heterocyclic groups, and n represents an integer of from 0 to 3. When n has a value of 2 or 3, the plural groups represented by $R^1$, $R^2$ or $R^3$ may be the same or different. Furthermore, at least one of the groups represented by $R^1$, $R^2$ and $R^3$ preferably has at least 8 carbon atoms.

Actual examples of image forming compounds which can be used in this invention are indicated below, but the compounds which can be used are not limited to these examples.

(1)

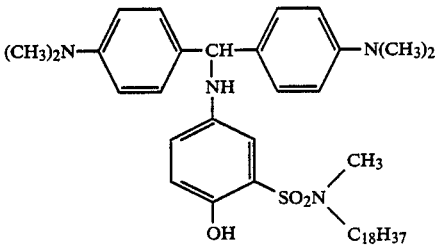

(2)

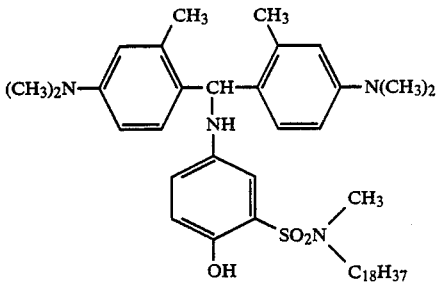

-continued
(3)
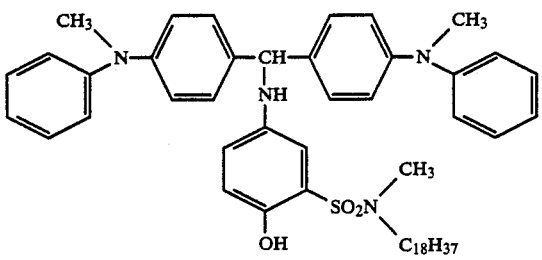
(4)
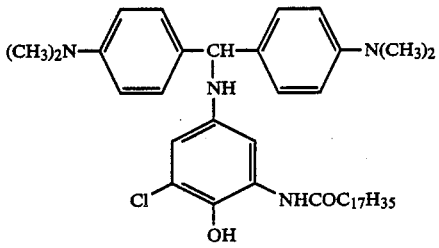
(5)
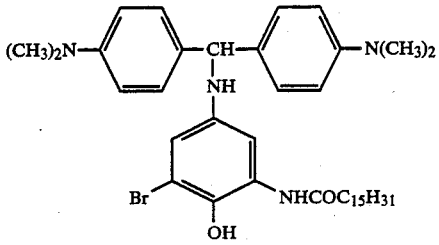
(6)
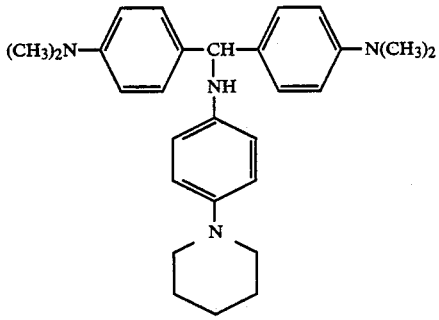
(7)
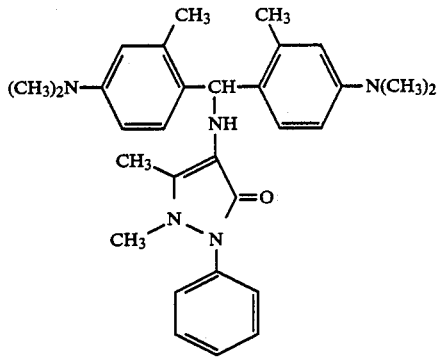
-continued
(8)
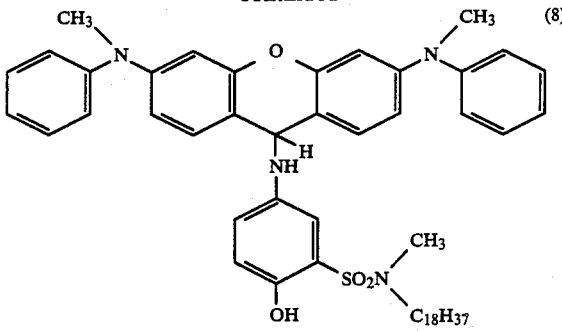
(9)
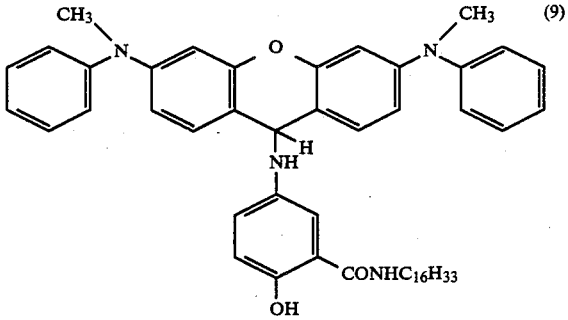
(10)
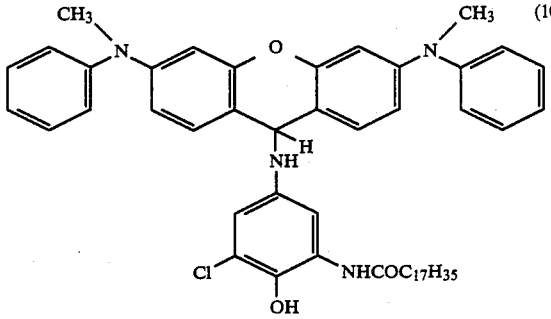
(11)
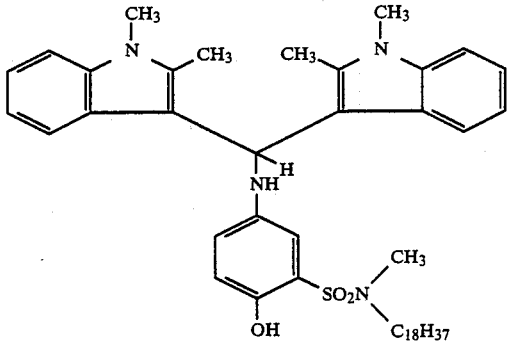
(12)
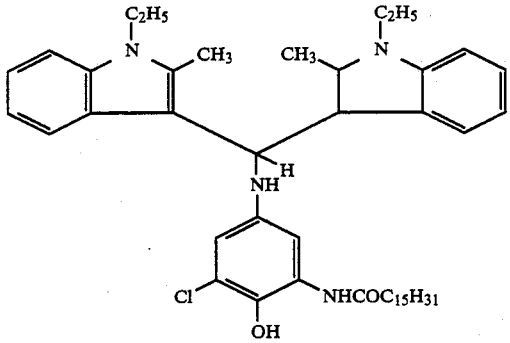

-continued
(13)
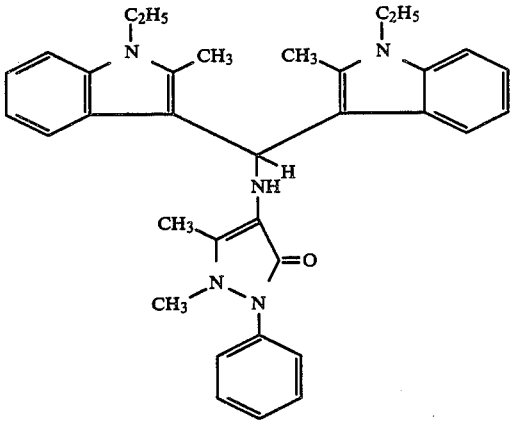
(14)
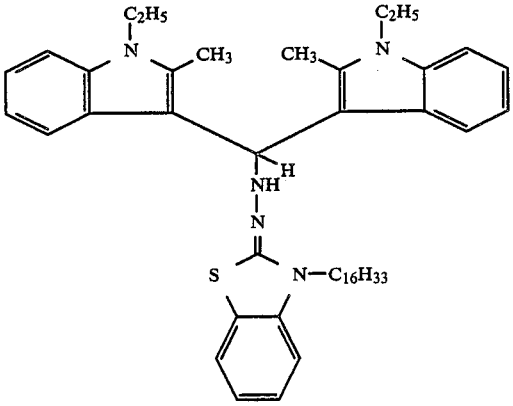
(15)
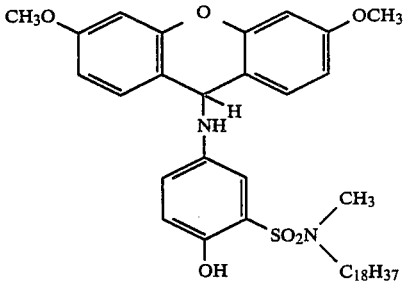
(16)
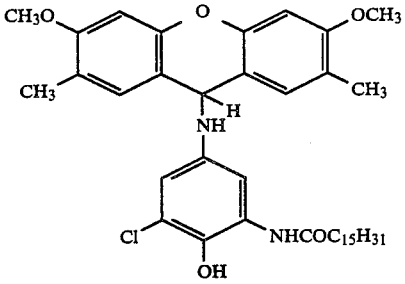
-continued
(17)
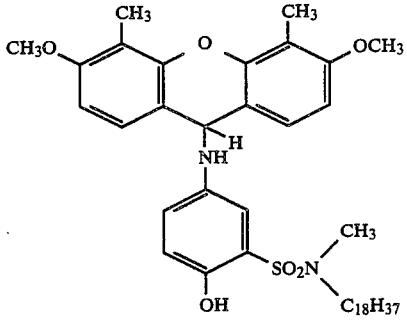
(18)
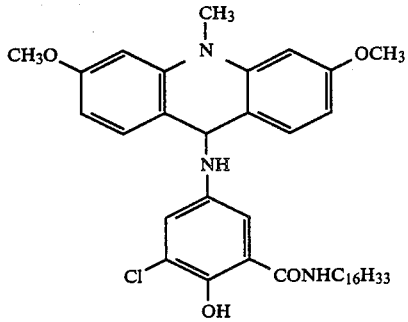
(19)
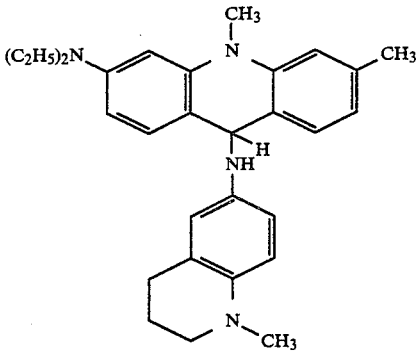
(20)
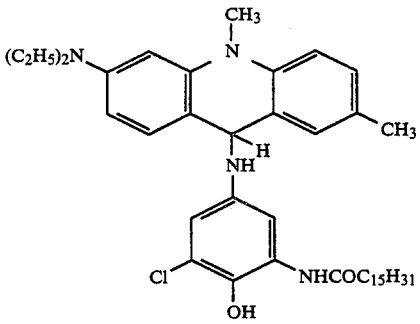

-continued
(21)
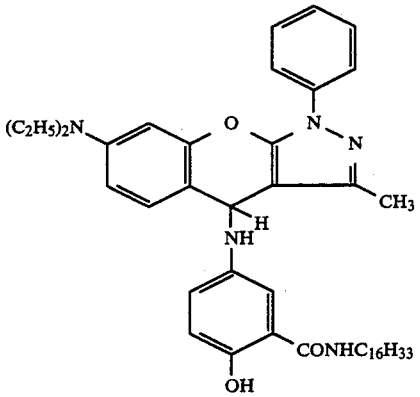
(22)
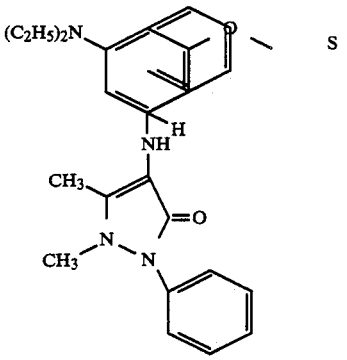
(23)
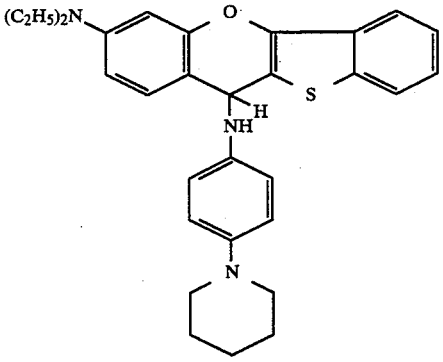
(24)
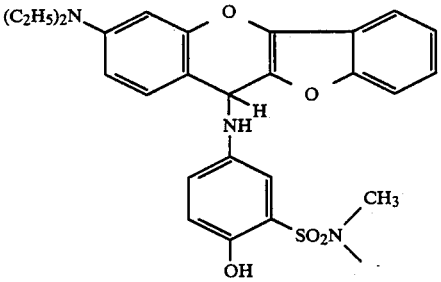
(25)
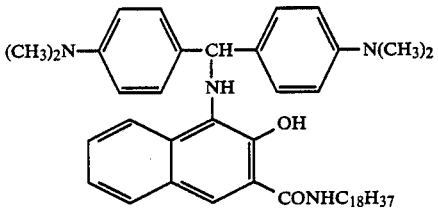
-continued
(26)
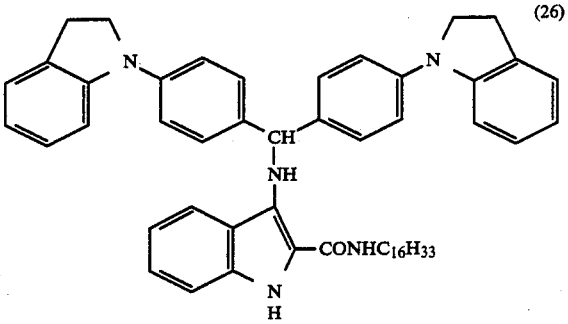
(27)
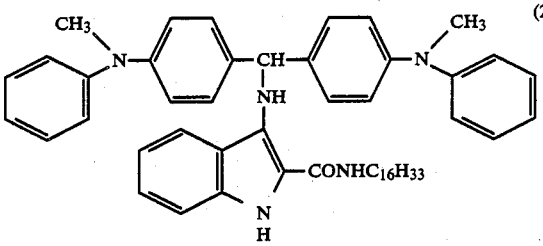
(28)
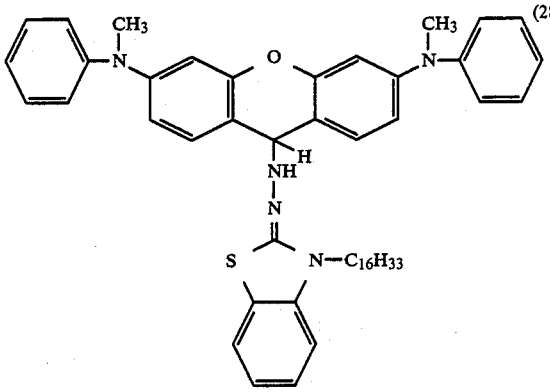
(29)
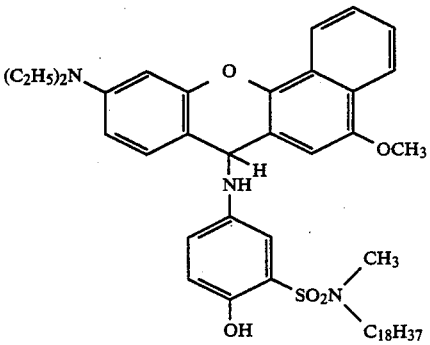
(30)
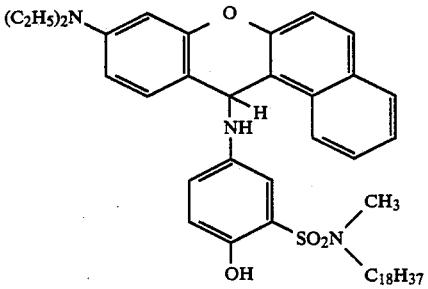

-continued
(31)
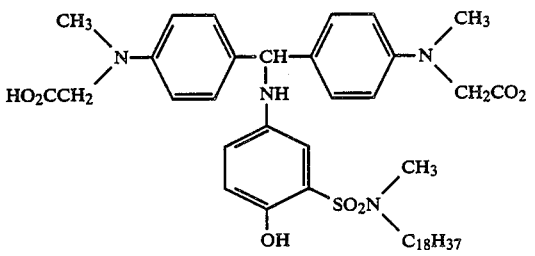
(32)
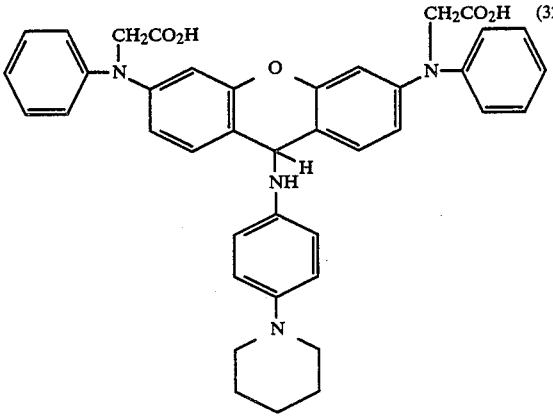
(33)
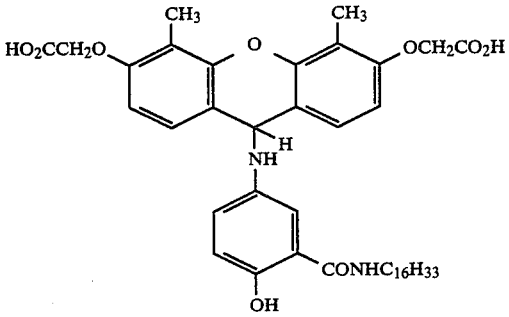
(34)
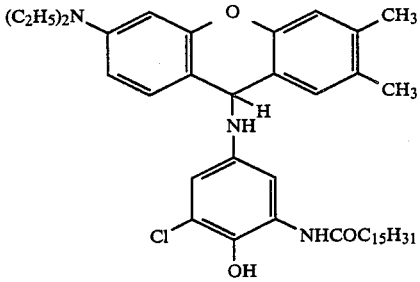
(35)
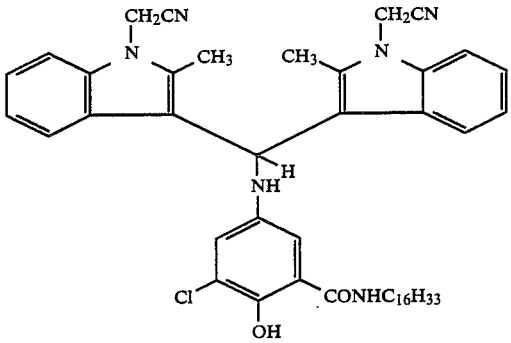
-continued
(36)
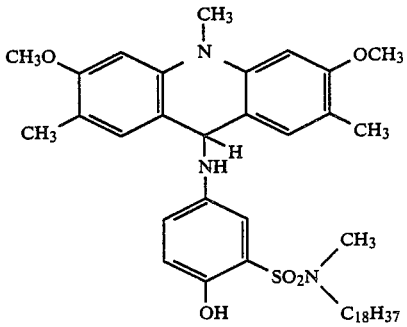
(37)
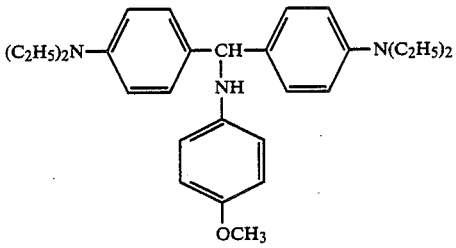
(38)
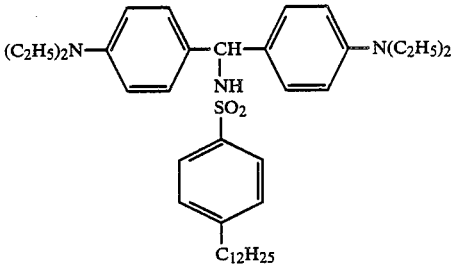
(39)
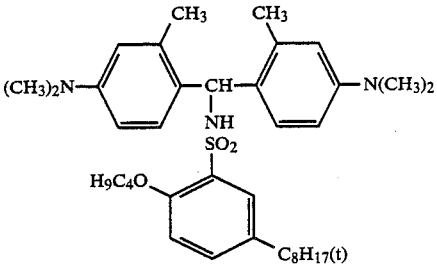
(40)
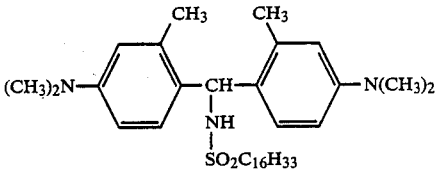
(41)
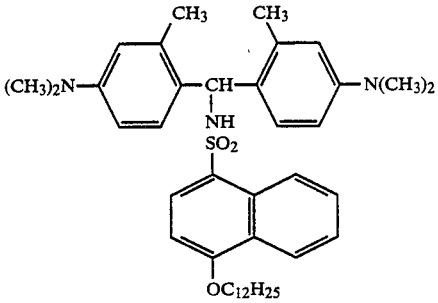

-continued

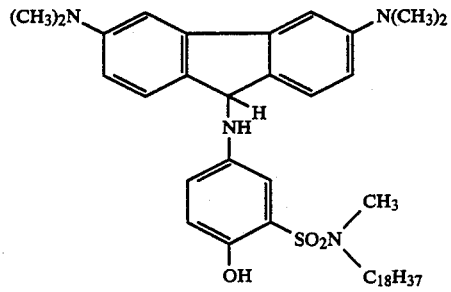

(42)

Among the above compounds (1) to (42), compounds (1), (2), (3), (4), (5), (11), (12), (16) and (18) are especially preferred.

Methods for the synthesis of image forming compounds of this invention are described below.

Any method can be used for the synthesis of the image forming compounds of this invention. The most general method is outlined schematically below.

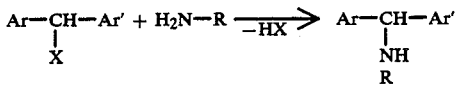

(X: OH, $OSO_2R^4$ or halogen, where $R^4$ is an alkyl group or an aryl group.

Actual examples of synthesis are described below.

Example of the Synthesis of Image Forming Compound (1)

Fifty one grams of 4-chloro-3-(N-methyl-N-octadecyl sulfamoyl)nitrobenzene prepared from 2-chloro-5-nitrobenzenesulfonyl chloride and methyloctadecylamine was dissolved in 200 ml of dimethylsulfoxide and 30% aqueous potassium hydroxide was added dropwise at room temperature. After the addition, the mixture was stirred at 40° C. for a period of 2 hours and then the reaction mixture was poured into cold dilute hydrochloric acid and the pale yellow crystals which formed were recovered by filtration.

These crystals were dissolved by heating with a mixture of 300 ml of ethanol and 50 ml of 10% aqueous sodium hydroxide solution, after which 50 grams of sodium hydrosulfide was added in small aliquots at a temperature of 40 to 50° C.

After this addition, 200 ml of water was added gradually and then the mixture was heated to 50° C. and stirred for 10 minutes.

After cooling, the light brown sediment which had precipitated out was recovered by filtration and recrystallized from acetonitrile, whereupon 28.5 grams of off-white crystals of 4-amino-2-(N-methyl-N-octadecylsulfamoyl)phenol was obtained.

Next, 3.7 grams of the aminophenol derivative so obtained, 8.12 grams of Michler's hydrol and 50 ml of ethanol were heated together under reflux for 30 minutes. The mixture was left to stand overnight and the pale blue crystals which precipitated out were recovered by filtration. The recovery was 17.8 grams.

This crude product was recrystallized from methanol/ethanol (4/1), whereupon white crystals of image forming compound (1) of this invention were obtained. Melting point: 76 to 78° C.

When photosensitive materials formed by coating image forming compounds of thls invention, together with a silver halide emulsion, on a support are developed under alkaline conditions after imagewise exposure to light and treated subsequently with acid, a diffusible dye is released in the region where development of the silver halide has not taken place. A dye image is then obtained when this diffusible dye is transferred to a dye fixing material.

The inventors consider that this phenomena arises in the way indicated schematically below.

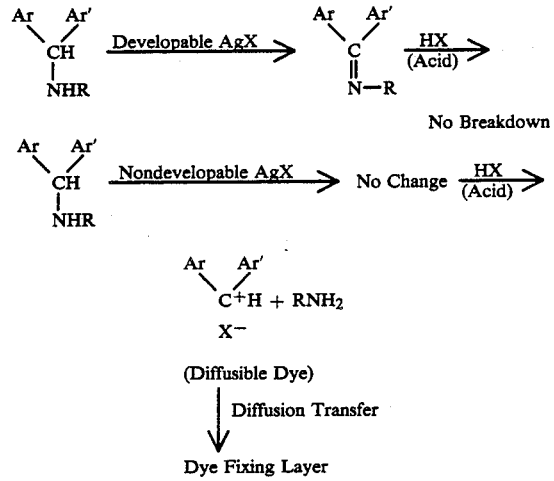

The distinguishing features of the system in which the image forming compounds of this invention are used are considered that silver development processing is carried out under alkaline conditions after imagewise exposure and that in the developed parts, the image forming compounds of this invention are oxidized and converted into structures which do not release a diffusible dye, and, in the undeveloped parts, the carbon-nitrogen bond in the image forming compound of this invention is cleaved by treatment with an acidic substance to release a diffusible dye which is transferred.

Hence, with this system, the important factors are the effective oxidation of the image forming compound by development and, at the same time, the effective formation of a diffusible dye (yellow, magenta, cyan) from the unoxidized compound and the reliable fixing of the diffusible dye in the dye fixing layer.

As a result of thorough investigation from these points of view, the inventors have discovered that the aforementioned moieties of formulae (I) to (VI) are preferred as reducing moieties for oxidizing effectively the image forming compounds, and that acids of which the pKa value is not more than 4 are preferred for forming diffusible cationic dyes effectively from the unoxidized material. Furthermore, the inventors have discovered that anionic polymers are preferred for fixing the cationic dyes in the dye fixing layer.

Examples of the acid having a pKa of not more than 4 include organic acids such as malonic acid, oxalic acid, salicylic acid, sulfosalicylic acid, p-phenolsulfonic acid, β-resorcylic acid, γ-resorcylic acid, gallic acid, cyanoacetic acid, methylsulfonic acid, chloroacetic acid, orthanilic acid, methyanilic acid, benzenesulfonic acid, toluenesulfonic acid, sulfamic acid, maleic acid, naphthalenesulfonic acid and tartaric acid, and inorganic acids such as phosphoric acid. Among these acids, those soluble in water are especially preferred.

Examples of the anionic polymers for fixing the cationic dyes in the dye fixing layer include polymers made by polymerization or copolymerization using acrylic acid, methacrylic acid, styrenesulfonic acid, styrenesulfinic acid, maleic acid, etc. as vinyl monomer components, condensation polymers of formaldehyde and phenols, bisphenols, salicylic acid, etc., and polymers obtained by the condensation of diols or diamines with 5-sulfo-isophthalic acid, trimelitic acid, pyromelitic acid, etc. Furthermore, the acidic developers (for example, acidified kaolin, zinc salts of salicylic acids, condensation products of formaldehyde with phenols and salicylic acids) normally used for pressure sensitive papers, etc., are also effective for this purpose.

By combining these elements it is possible to retain the unoxidized image forming compound in the form of an image corresponding to the original picture at the time of development when a negative emulsion is used, after which a diffusible dye can be released from this material by the action of an acidic substance and this dye can be transferred to provide color images which have excellent discrimination.

If a direct reversal emulsion is used the unoxidized image forming compound remains in the form of an image counter corresponding to the original picture to provide a negative image.

The development of the color photosensitive materials of this invention can be carried out in development baths in the normal temperature range (usually up to about 45° C.), or by means of thermal development (50° C. to 250° C.). In any case, development of the developable silver halide with a compound of formulae (A) occurs when the photosensitive layer of the photosensitive material is made alkaline.

All the known methods can be used for rendering the photosensitive layer alkaline. For example, methods in which a base is applied from the outside to the photosensitive material and methods in which a base precursor is incorporated in the photosensitive material can be used for this purpose.

Examples of methods in which a base is applied from the outside include methods in which an aqueous solution of ammonia is applied to the sensitive material and methods in which a sheet containing a base is brought into contact with the photosensitive material.

Base precursors include salts of bases with organic acids which are decarboxylated by heating, compounds which release amines by means of an intramolecular nucleophilic reaction, a Lossen rearrangement or a Beckmann rearrangement, and compounds which form bases by electrodecomposition.

Actual examples of base precursors include guanidine trichloroacetic acid, piperidine trichloroacetic acid, morpholine trichloroacetic acid, p-toluidine trichloroacetic acid, 2-picoline trichloroacetic acid, guanine phenylsulfonylacetate, guanine 4-chlorophenylsulfonylacetate, guanine 4-methylsulfonylphenylsulfonylacetate and guanine 4-acetylaminophenylpropionate.

The amount of the base or base precursor which can be used in photosensitive materials of this invention varies over a wide range. The use of an amount of base or base precursor not more than 50 wt% calculated with respect to the weight of the coated film of the photosensitive layer is general, and the use of an amount within the range from 0.01 to 40 wt% is preferred. In the invention the base and/or base precursors can be used individually or in the form of mixtures containing two or more types.

Furthermore, the base precursors in which use is made of a complex forming reaction, which is combinations of sparingly soluble metal compounds (such as zinc hydroxide) and compounds (such as guanidine picolinate) which can undergo a complex forming reaction with the metal ions from which these sparingly soluble metal compounds are formed, as disclosed in EP 210,660, can also be used as a type of base precursor. When such combinations are used, systems in which the sparingly soluble metal compound is incorporated in the photosensitive material and the complex forming compound is supplied from the outside are preferred for providing better storage properties for the photosensitive material.

Method of supplying the complex forming compound from the outside include methods in which an aqueous solution of the complex forming compound is applied and methods in which a sheet which contains the complex forming compound is brought into contact with the photosensitive material. In the case of the latter method it is necessary to moisten the sheet or the photosensitive material with water.

As a general rule, no reducing agent for the silver halide other than the compound of formula (A) is required to develop the photosensitive materials of this invention, but other reducing agents can be used, depending on the particular case. Silver halide reducing agents which develop silver halide to form an oxidized form which can then undergo a cross-oxidation with the compound of formula (A) can also be used for this purpose. Various compounds of this type are known, and examples of such compounds include those disclosed on pages 78 to 96 of EP 220,746. The use of 1-phenyl-3pyrazolidone and derivatives thereof, and aminophenol and derivatives thereof, is especially preferred.

These auxiliary reducing agents may be supplied to the photosensitive material from the outside (for example, they may be included in the aforementioned aqueous alkaline solution or complex forming compound aqueous solution, or they may be included in the sheet which contains the base or complex forming compound), or they may be incorporated into the photosensitive material.

Examples of the methods by which an acidic substance (acidic compound) is made to act upon a color photosensitive material after development had been completed include methods in which an aqueous solution of an acidic substance is applied to the photosensitive material and methods in which a sheet which contains an acidic substance is brought into contact with the photosensitive material. The sheet which contains an acidic substance may be a dye fixing material for fixing the diffusible dye. Furthermore, acid precursors which release acids on heating can also be used. These acid precursors may be incorporated in the photosensitive material or they may be contained in a separate sheet from the photosensitive material which is then brought into contact with the photosensitive material and heated. Such a sheet may also function as a dye fixing material. Development must be carried out under conditions such that the acid precursor is not broken down in cases where the acid precursor is incorporated into the photosensitive material. The simplest method involves carrying out development at a temperature below the degradation temperature of the acid precursor, e.g., developed at 90° C. or lower and degradated at 120 to 150° C. In such a case, the development may be carried out, for example, using an aqueous alkaline solution or using a method in which a base precursor which can form a base at a temperature below the degradation temperature of the acid precursor is used. The acid precursor is preferably added to the material in the form of fine particle dispersion in an amount of from 1 to 5 $g/m^2$.

The compounds which release an acid by way of a Beckmann rearrangement or a Lossen rearrangement disclosed, for example, in U.S. Pat. No. 4,656,126 and 4,610,957 can be used as acid precursors.

Transfer of the diffusible dye can be achieved by means of a solvent such as water, or by heating, or by a combination of these methods. In cases where the transfer is achieved by heating, dye transfer can be accelerated by the incorporation in the photosensitive material or dye fixing material of a thermal solvent which is a solid at normal temperature but which is melted by heating. Examples of thermal solvents include ureas, pyridines, amides, sulfonamides, imides, anisoles and oximes.

Methods of heating in the transfer process may involve bringing into contact with a heated block or plate, bringing into contact with an infrared or far infrared heater such as a hot plate, hot presser, heated roller or a halogen lamp heater, or passing through a high temperature atmosphere. Moreover, these methods can also be used to achieve thermal development.

The method disclosed on page 27 of JP-A-61-147244 can be used as a method in which the photosensitive material and the dye fixing material are superimposed on one another and pressure is applied while the two are in intimate contact.

Silver chloride, silver bromide, silver iodobromides, silver chlorobromides, silver chloroiodides and silver chloroiodebromides can be used, for example, as the silver halide in this invention.

The silver halide emulsions which are used in the invention are preferably surface latent image type emulsions, but internal latent image type emulsions can also be used. Internal latent image type emulsions are combined with nucleating agents or light fogging and function as direct reversal emulsions and so a negative dye image of the original is obtained in cases where they are combined with a compound of formula (A) of this invention. Furthermore, so-called core/shell emulsions in which the interior of the grains and the surface layer of the grains consist cf different phases can also be used. The silver halide emulsions may be monodisperse or poly-disperse, and mixture of mono-disperse emulsions can also be used. The grain size is preferably from 0.1 to 2 μm, and more preferably from 0.2 to 1.5 μm. The crystal habit of the silver halide grains may be cubic, octahedral, tetradecahedral, tabular with a high aspect ratio or of any other form.

In practice, any of the silver halide emulsions disclosed, for example, in column 50 of U.S. Pat. No. 4,500,626, U.S. Pat. No. 4,628,021, *Research Disclosure* (referred to hereinafter as RD) 17029 (1978) and JP-A-62-253159 can be used.

The silver halide emulsions can be used as they are after ripening, but they are usually subjected to chemical sensitization. The known methods of sulfur sensitization, reduction sensitization and noble metal sensitization which are used for normal type photosensitive material emulsions can be used either individually or in combinations. The chemical sensitization can also be carried out in the presence of nitrogen containing heterorcyclic compounds (JP-A-62-253159).

The coated weight of photosensitive silver halide used in the invention is preferably within the range from 1 $mg/m^2$ to 10 $g/m^2$, calculated as silver.

In cases where thermal development is carried out, the development can be accelerated and other effects can be achieved by using an organic metal salt as an oxidizing agent conjointly with the photosensitive silver halide. The use of organic silver salts from among the organic metal salts of this type is especially desirable.

The benzotriazoles, aliphatic acids and other compounds disclosed in columns 52 to 53 of U.S. Pat. No. 4,500,626 are examples of organic compounds which can be used to form the above mentioned organic silver salt oxidizing agents. Furthermore, the silver salts of carboxylic acids which have alkyl groups, such as the silver phenylpropiolate disclosed in JP-A-60-113235 and the silver acetylenes disclosed in JP-A-61-249044 are also useful compounds in this respect. Two or more organic silver salts can be used conjointly.

The above mentioned organic silver salts can be used at rates of from 0.01 to 10 mol, and preferably at rates of from 0.01 to 1 mol, per mol of photosensitive silver halide. A total coated weight of photosensitive silver halide and organic silver salt, calculated as silver, of from 50 $mg/m^2$ to 10 $g/m^2$ is preferred.

Various antifoggants and photographic stabilizers can be used in this invention. Examples of such compounds include the azoles and azaindenes disclosed on pages 24 to 25 of RD 17643 (1978), the nitrogen containing carboxylic acids and phosphoric acids disclosed in JP-A-59-168442, the mercapto compounds and metal salts thereof disclosed in JP-A-59-111636 and the acetylene compounds disclosed in JP-A-62-87957.

The silver halides used in the invention may be spectrally sensitized using methine dyes or by other means. Cyanine dyes, merocyanine dyes, complex cyanine dyes, complex merocyanine dyes, holopolar cyanine dyes, hemicyanine dyes, styryl dyes and hemioxonol dyes are included among the dyes which can be used for this purpose.

In practical terms, examples of sensitizing dyes have been disclosed in U.S. Pat. No. 4,617,257, JP-A-59-180550 and JP-A-60-140335, and on pages 12 to 13 of RD 17029 (1978).

These sensitizing dyes may be used individually or in combinations, and combinations of sensitizing dyes are often used, in particular, to achieve supersensitization.

Compounds which exhibit supersensitivity, being dyes which themselves have no spectral sensitization effect or compounds which have essentially no absorption in the visible region (for example, those disclosed in U.S. Pat. No. 3,615,641 and JP-A-63-23145) can also be included along with the sensitizing dyes.

The sensitizing dyes may be added to the emulsion during, or before or after, chemical ripening, or they may be added before or after nuclei formation of the silver halide grains, as described in U.S. Pat. Nos. 4,183,756 and 4,225,666. The amount added is generally within the range from about $10^{-8}$ to about $10^{-2}$ mol per mol of silver halide.

Combinations of at least three silver halide emulsion layers which are photosensitive to different spectral regions can be used to obtain colors over a wide range of the chromaticity diagram using the three primary colors yellow, magenta and cyan. For example, three layer combinations consisting of a blue sensitive layer, a green sensitive layer and a red sensitive layer, and combinations consisting of a green sensitive layer, a red sensitive layer and an infrared sensitive layer can be used. The various arrangements and sequences known for ordinary color photosensitive materials can be adopted for the photosensitive layers. Furthermore, each of the photosensitive layers may be divided into two or more layers, as required.

Various auxiliary layers, for example, protective layers, under-layers, intermediate layers, yellow filter layers, anti-irradiation layers and backing layers, can be established in the photosensitive materials.

The use of hydrophilic binders in the structural layers of the photosensitive elements and dye fixing elements is preferred. Examples have been disclosed on pages 26 to 28 of JP-A-62-253159. In practice, the use of transparent or semi-transparent hydrophilic binders is preferred, and examples of such materials include natural compounds, such as proteins, for example, gelatin and gelatin derivatives, or polysaccharides, for example, cellulose derivatives, starch, gum arabic, dextran and pullulan, and poly(vinyl alcohol), polyvinylpyrrolidone, acrylamide polymers and other synthetic polymeric compounds. Furthermore, the highly water absorbant polymers disclosed, for example, in JP-A-62-245260, which is to say homopolymers of vinyl monomers which have —COOM or —$SO_3M$ groups (where M represents a hydrogen atom or an alkali metal) or copolymers of these vinyl monomers with other vinyl monomers (for example, sodium methacrylate, ammonium methacrylate and "Sumika gel L-5H" made by Sumitomo Chemical Co.) can be used for this purpose. Two or more of these binders can be used in combination.

In cases in which systems in which a trace of water is supplied and thermal development is carried out, water absorption can be achieved rapidly if the above mentioned highly absorbant polymers are used. Furthermore, transfer back of the dye from the dye fixing element to the other element can be prevented if a highly absorbant polymer is used in the dye fixing layer and the protective layer thereof.

In this invention, the coated weight of binder is preferably not more than 20 $g/m^2$, more preferably not more than 10 $g/m^2$, and most preferably not more than 7 $m/g^2$.

Various polymer latexes can also be included in the structural layers (including backing layers) of the photosensitive materials and dye fixing materials with a view to improving the film properties by, for example, providing dimensional stability, anti-curl properties and anti-stick properties, by preventing the films from cracking and by preventing pressure sensitization and desensitization. In practice, use can be made of any of polymer latexes disclosed, for example, in JP-A-62-245258, JP-A-62-136648 and JP-A-62-110066. Cracking of the mordanting layer can be prevented in particular by using a polymer latex which has a low glass transition point (below 40°) in the mordanting layer, and an anti-curl effect can be achieved by using a polymer latex which has a high glass transition point in the backing layer.

In this invention, reducing agents which are fast to diffusion can be used to prevent color casts and undesirable oxidation of the compounds of formula (A) during the storage of the photosensitive materials. In agents (electron transfer agents) for the silver halide is used, the addition of reducing agents which are fast to diffusion to the intermediate layers is especially effective for preventing the formation of color casts due to the migration of the electron transfer agent between photosensitive layers. Reducing agents of this type selected from among the reducing agents and reducing agent precursors which are fast to diffusion disclosed, for example, in columns 49 to 50 of U.S. Pat. No. 4,500,626, columns 30 to 31 of U.S. Pat. No. 4,483,914, U.S. Pat. Nos. 4,330,617 and 4,590,152, pages 17 to 18 of JP-A-60-140335, JP-A-57-40245, JP-A-56-138726, JP-A-59-178458, JP-A-59-53831, JP-A-59-182449, JP-A-59-182450, A-60-119555, JP-A-60-128436, JP-A-60-128439, JP-A-60-198540, JP-A-60-181742, JP-A-61-259253, JP-A-62-244044, JP-A-62-131253, JP-A-62-131256, and pages 78 to 96 of European Pat. No. 220,746A2 can be used for this purpose.

The hydrophobic additives such as the image forming compounds of this invention can be incorporated into the layers of the photosensitive materials using known methods, such as that disclosed in U.S. Pat. No. 2,322,027. In this case, the high boiling point organic solvents disclosed, for example, in JP-A-59-83154, JP-A-59-178451, JP-A-59-178452, JP-A-59-178453, JP-A-59-178454, JP-A-59-178455 and JP-A-59-178457 can be used, and they can be used conjointly with low boiling point organic solvents of boiling point from 50° C. to 160° C., as required.

The amount of high boiling point organic solvent used is preferably not more than 10 g, and more preferably not more than 5 g, per gram of image forming compound used. Furthermore, not more than 1 cc, preferably not more than 0.5 cc, and most desirably not more than 0.3 cc, per gram of binder is appropriate.

The method of dispersion with polymers disclosed in JP-B-51-39853 and JP-A-51-59943 can also be used.

In cases where the compound is essentially insoluble in water, it can be included by dispersion as fine particles in the binder rather than using the aforementioned methods.

Various surfactants can be used when dispersing a hydrophobic compound in a hydrophilic colloid. For example, the surfactants disclosed on pages 37 to 38 of JP-A-59-157636 can be used for this purpose.

Compounds which are intended to activate development in the photosensitive material and, at the same time, stabilize the image can be used in this invention. Actual compounds which are preferred for this purpose have been disclosed in columns 51 to 52 of U.S. Pat. No. 4,500,626.

A dye fixing material is used together with the photosensitive material in this system in which an image is formed by the diffusion transfer of dye. There are embodiments in which the dye fixing material is coated as a separate coating on a different support from the photosensitive material and embodiments in which it is coated on the same support as the photosensitive material. The relationship between the photosensitive material and the dye fixing material, the relation ship with the support and the relationship with the white reflecting layer disclosed in column 57 of U.S. Pat. No. 4,500,626 can also be applied to this invention.

The dye fixing material preferably used in the invention contains least one layer containing the aforementioned anionic polymers.

Auxiliary layers, such as protective layers, peeling layers and anti-curling layers, can be established, as required, in the dye fixing material. The establishment of a protective layer is especially useful.

High boiling point organic solvents can be used in the structural layers of the photosensitive materials and dye fixing materials as plasticizers, slip-agents or for improving the peelability of the photosensitive material and the dye fixing material. Actual examples have been disclosed, for example, on page 25 of JP-A-62-253159, and JP-A-62-245253.

Moreover, various silicone oils (all silicone oils from dimethylsilicone oil through to modified silicone oils in which various organic groups have been introduced into dimethylsiloxane) can also be used for the purpose described above. The various modified silicone oils described in Technical Data Sheet P-6-18B, entitled *Modified Silicone Oils* and published by the Shin-Etsu Silicone Co. can be used, for example, and the use of carboxy-modified silicones (trade name X-22-3710 made by Shin-Etsu Silicone Co.), for example, is especially effective.

The silicone oils disclosed in JP-A-62-215953 and Japanese Patent Application No. 62-23687, are also effective.

Anti-fading agents may be used in the photosensitive materials and dye fixing materials. Examples of anti-fading agents include antioxidants, ultraviolet absorbers and metal complexes.

Antioxidants include, for example, chroman based compounds, coumaran based compounds, phenol based compounds (for example, hindered phenols), hydroquinone derivatives, hindered amine derivatives and spiroindane based compounds. Furthermore, the compounds disclosed in JP-A-61 159644 are also effective.

Benzotriazole compounds (e.g., U.S. Pat. No. 3,533,794), 4-thiazolidone based compounds (e.g., U.S. Pat. No. 3,352,681), benzophenone based compounds e.g., JP-A-46-2784) and the other compounds disclosed, for example, in JP-A-54-48535, JP-A-62-136641 and JP-A-61-88256 can be used as ultraviolet absorbers. Furthermore, the ultraviolet absorbing polymers disclosed in JP-A-62-260152 are also effective as ultraviolet absorbers.

The compounds disclosed in U.S. Pat. No. 4,241,155, columns 3 to 36 of U.S. Pat. No. 4,245,018, columns 3 to 8 of U.S. Pat. No. 4,254,195, JP-A-62-174741, pages 27 to 29 of JP-A-61-88256 and JP-A-1-75568 can be used as metal complexes.

Examples of useful anti-fading agents have been disclosed on pages 125 to 137 of JP-A-62-215272.

Anti-fading agents for preventing fading of the dyes which have been transferred into the dye fixing material may be included beforehand in the dye fixing material or they may be supplied to the dye fixing material from the outside, from the photosensitive material, for example.

The above mentioned antioxidants, ultraviolet absorbers and metal complexes may also be used in conjunction with one another.

Fluorescent whiteners can be used in the photosensitive materials and dye fixing materials. The fluorescent whiteners are preferably incorporated into the dye fixing material or supplied to the dye fixing material from the outside, from the photosensitive material for example. Examples of such compounds have been disclosed, for example, in *The Chemistry of Synthetic Dyes*, volume V, chapter 8 (edited by K. Venkataraman), and in JP-A-61-143752. In more practical terms, these compounds include stilbene based compounds, coumarin based compounds, biphenyl based compounds, benzoxazolyl based compounds, nathphalimide based compounds, pyrazoline based compounds and carbostyril based compounds.

Fluorescent whiteners can be used in combination with anti-fading agents.

The film hardening agents disclosed, for example, in column 41 of U.S. Pat. Nos. 4,678,739, JP-A-59-116655, JP-A-62-245261 and JP-A-61-18942 can be used as film hardening agents in the structural layers of the photosensitive materials and dye fixing materials. Actual examples of such compounds include the aldehyde based film hardening agents (for example formaldehyde), aziridine based film hardening agents, epoxy based film hardening agents

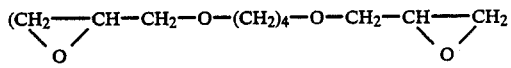

for example), vinylsulfone based film hardening agents, (for example, N,N'-ethylenebis(vinylsulfonylacetamido)ethane), N-methylol based film hardening agents (for example, dimethylolurea), and the polymeric film hardening agents (the compounds disclosed, for example, in JP-A-62-234157).

Various surfactants can be used as coating promotors, for improving the peeling properties, for improving slip properties, as anti-static agents and for accelerating development, etc., in the structural layers of the photosensitive materials and dye fixing materials. Actual example of surfactants have been disclosed, for example, in JP-A-62-173463 and JP-A-62-183457.

Organic fluorine compounds can be included in the structural layers of the photosensitive materials and dye fixing materials for improving slip properties, as anti-static agents and for improving the peeling properties, etc. Typical examples of organic fluorine compounds include the fluorine based surfactants disclosed, for example, in columns 8 to 17 of JP-B-57-9053, JP-A-61-20944 and JP-A-62-135826, and the hydrophobic fluorine compounds including oil-like fluorine compounds such as fluoro-oils and solid fluorine compounds such as tetrafluoroethylene resins.

Matting agents can be used in the photosensitive materials and dye fixing materials. Examples of matting agents include, as well as silicon dioxide and the compounds such as polyolefins and polymethacrylates disclosed on page 29 of JP-A-61-88256, compounds such as the benzoguanamine resin beads, polycarbonate resin beads, and AS (acrylonitril-styrene) resin beads, etc., disclosed in JP-A-63-274944 and JP-A-63-274952.

Paper and synthetic polymers (films) are generally used for the supports for the photosensitive materials and dye fixing materials of this invention. In practical terms, use can be made of films of polyethyleneterephthalate, polycarbonate, poly(vinyl chloride), polystyrene, polypropylene, polyimide, celluloses (for example, triacetylcellulose) and films obtained by including pigments such as titanium oxide in these films, film type synthetic papers made from polypropylene, etc., mixed papers made using natural pulp and synthetic resin pulp such as a polyethylene pulp, yankee papers, baryta papers, coated papers (especially cast coated papers), metals, cloths and glasses, etc.

These can be used individually, or they can be used in the form of laminated supports which are laminated on one or both sides with a synthetic polymer such as polyethylene.

Moreover, the supports disclosed on pages 29 to 31 of JP-A-62-253159 can also be used.

Semiconductor metal oxides such as alumina sol or tin oxide, or carbon black or some other anti-static agent can be coated with a hydrophilic binder on the surfaces of these supports.

The methods of exposing and recording images on the photosensitive material include methods in which a scene or person, for example, is photographed directly using a camera, etc., methods in which exposures are made through a reversal film or a negative film using a printer or an enlarger, for example, methods in which a scanning exposure of an original image is made through a slit using the exposing apparatus of a photocopying machine, for example, methods in which exposures are made with the light emitted from light emitting diodes and various types of laser, passing the image information as an electrical signal, and methods in which exposures are made either directly or via an optical system with the output of image information to an image display device such as a CRT (cathode-ray tube), liquid crystal display, electroluminescence display or a plasma display, for example. As mentioned above, natural light, tungsten lamps, light emitting diodes, laser light sources, CRT light sources, and the light sources which have been disclosed in column 56 of U.S. Pat. No. 4,500,626, can be used as light sources for recording images on the photosensitive material.

Furthermore, image exposures can be made using a wavelength modifying element in which a coherent light source such as a laser is combined with a non-linear optical material. In this context, a non-linear optical material is a substance with which non-linearity between the electric field and the polarization which appears when a strong photoelectric field such as laser light is imposed can be achieved, and the use of inorganic compounds as typified by lithium niobate, potassium dihydrogen phosphate (KDP), lithium iodate and $BaB_2O_4$, and urea derivatives, nitroaniline derivatives, nitropyridine-N-oxide derivatives, for example, 3-methyl-4-nitropyridine-N-oxide (POM), and the compounds disclosed in JP-A-61-53462 and JP-A-62-210432 for this purpose is preferred. The wavelength converting element may be used in any of the known forms, such as a single crystal light wave guide or a fiber.

Furthermore, image signals obtained from video cameras and electronic still cameras, etc., television signals as typified by the Japanese Television Signal Standard (NTSC), image signals obtained by splitting up an original image into a large number of picture elements with a scanner, for example, and image signals formed using a computer as typified by CG (computer graphics) and CAD (computer assisted drawing) can be used for the aforementioned image information.

There are also embodiments in which the photosensitive material and/or dye fixing material has an electrically conductive heater as a heating device for thermal development or for the diffusion transfer of the dye. In such a case, the transparent or semitransparent heating elements disclosed in JP-A-61-145544 can be used. Moreover, these electrically conductive layers also function as anti-static layers.

The invention is described in more detail below by means of illustrative examples, but the invention is not construed as being limited thereto.

EXAMPLE 1

The preparation of a silver benzotriazole emulsions is described.

Twenty eight grams of gelatin and 13.2 grams of benzotriazole were dissolved in 300 ml of water. The solution was stirred while being maintained at a temperature of 40° C. A solution obtained by dissolving 17 grams of silver nitrate in 100 ml of water was then added to the solution over a period of 2 minutes.

The pH of the silver benzotriazole emulsion was adjusted, the emulsion was precipitated and the excess salt was removed. Subsequently, the pH was set to 6.30 and 400 grams of silver benzotriazole emulsion was recovered.

The method used to form a silver halide emulsion is described below.

Six hundred ml of an aqueous solution containing sodium chloride and potassium bromide and an aqueous solution of silver nitrate (obtained by dissolving 0.59 mol of silver nitrate in 600 ml of water) were added simultaneously at the same flow rates over a period of 40 minutes to an aqueous solution of gelatin (containing 20 grams of gelatin and 3 grams of sodium chloride in 1,000 ml of water, and maintained at 75° C.) which was being thoroughly stirred. A mono-disperse cubic silver chlorobromide emulsion (50 mol% bromide) of average grain size 0.40 μm was prepared in this way.

After washing with water and de-salting, 5 mg of sodium thiosulfate and 20 mg of 4-hydroxy-6-methyl-1,3,3a,7-tetra-azaindene were added and chemical sensitization was carried out at 60° C. The recovery of emulsion was 600 grams.

The method used to prepare a gelatin dispersion of the dye image forming compound is described below.

Five grams of the dye image forming compound (1) of this invention, 0.5 grams of succinic acid 2-ethylhexyl ester sulfonic acid, sodium salt, as a surfactant and 10 grams of triisononyl phosphate were weighed out and added to 30 ml of ethyl acetate. A uniform solution was then formed by warming the resulting mixture to about 60° C. After mixing, with stirring, 100 grams of a 10% aqueous gelatin solution with this solution, the solution was dispersed for 10 minutes at 10,000 rpm in a homogenizer. This dispersion is referred to as the image forming compound dispersion.

The color photosensitive material (A) of which the structure was as indicated in the following table was prepared using these materials. The values in parentheses are the coated amount.

| | |
|---|---|
| Second Layer | Gelatin (1,000 mg/m$^2$), Base precursor*1 (600 mg/m$^2$), Silica*2 (30 mg/m$^2$), Film hardening agent*3 (40 mg/m$^2$) |
| First Layer | The aforementioned silver chlorobromide emulsion (50 mol % bromide, coated wt. 400 mg(Ag)/m$^2$), Benzenesulfonamide (1,800 mg/m$^2$, The aforementioned silver benzotriazole emulsion (100 mg Ag/m$^2$), Sensitizing dye D-1 ($10^{-6}$ mol/m$^2$), Base precursor*1 (400 mg/m$^2$), Dispersion of the image forming compound (300 mg (as the image forming compound)/m$^2$), Gelatin (1000 mg/m$^2$), Triisononyl phosphate (600 mg/m$^2$), Surfactant*4 (100 mg/m$^2$) |
| Support | |

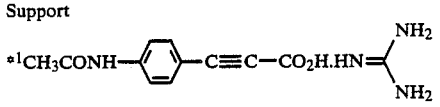

-continued

*2Size 4 μm

*3 1,2-Bis(vinylsulfonylacetamido)ethane

*4 $C_9H_{19}$— 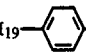 —$O(CH_2CH_2O)_8H$

Sensitizing Dye D-1:

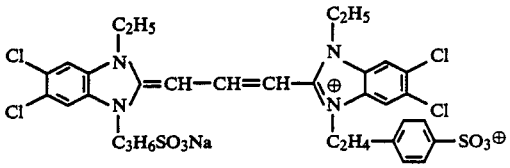

The preparation of a dye fixing material which has a dye fixing layer is described below. First of all, the gelatin film hardening agents H-1 (0.75 gram) and H-2 (0.25 gram) of which the structures are indicated below, 155 ml of water, 5 ml of a 1% surfactant W-1 of which the structure is indicated below, and 100 grams of 10% gelatin were formed into a uniform mixture. This mixture was coated uniformly so as to provide a wet film of thickness 60 μm on a paper support which had been laminated with polyethylene in which titanium oxide had been dispersed, and the coating was dried.

Gelatin Film Hardening Agent H-1

$CH_2{=}CHSO_2CH_2CONH{\cdot}CH_2CH_2NHCOCH_2{\cdot}SO_2CH{=}CH_2$

Gelating Film Hardening Agent H-2

$CH_2{=}CHSO_2CH_2CONHCH_2{\cdot}CH_2CH_2NHCOCH_2{\cdot}SO_2CH{=}CH_2$

Surfactant W-1

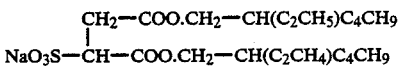

Next, 15 grams of the polymer (I) and 5 grams of the polymer (II) of which the structures are indicated below and 20 grams of sulfosalicylic acid were dissolved in 180 ml of water and this was mixed uniformly with 15 ml of 5% surfactant W-1 and 100 grams of 10% gelatin. The mixture was then coated uniformly to provide a wet film of thickness 150 μm on the above mentioned coated material. The resulting sample was dried to provide a dye fixing material.

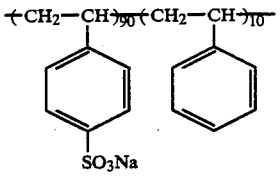

Polymer (I)

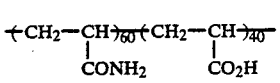

Polymer (II)

The aforementioned color photosensitive material was exposed for 1 second at 500 lux through a green filter of continually varying density (a 500–600 nm band pass filter) using a tungsten lamp. Subsequently, the material was heated uniformly for 30 seconds on a hot block which had been heated to 140° C.

Next, water was supplied to the film surface side of the dye fixing material in an amount of 15 ml per square meter, after which the above mentioned photosensitive material which had been subjected to the heat treatment was placed on top of the dye fixing material in such a way that the film surfaces were in close contact. The combination was then heated for 5 seconds on a heated block at 80° C., after which the dye fixing material and the photosensitive material were separated, whereupon a blue positive image in inverse correspondence to the exposure was obtained on the dye fixing material. The results obtained on making measurements with a Macbeth densitometer indicated a maximum density of 1.85 and a minimum density of 0.15, and excellent discrimination was achieved.

EXAMPLE 2

Photosensitive materials (B), (C), (D), (E) and (F) were prepared in the same way as in Example 1 except that the image forming compound (1) was replaced by the image forming compounds (2), (8), (11), (16) and (20). These were exposed and processed under the same conditions as described in Example 1 and the following results were obtained on measuring the densities of the positive colored images so obtained.

| Sensitive Material | Hue of the Dye Image | Dmax | Dmin |
|---|---|---|---|
| (B) | Cyan | 1.76 | 0.18 |
| (C) | Magenta | 1.80 | 0.20 |
| (D) | Magenta | 1.85 | 0.16 |
| (E) | Yellow | 1.62 | 0.15 |
| (F) | Yellow | 1.66 | 0.18 |

It is clear from the results shown in the table above that high discrimination was obtained in all cases.

EXAMPLE 3

Color photosensitive material (G) of which the structure is indicated below was prepared using the silver chlorobromide emulsion, a dispersion of image forming compound, etc. used in Example 1. The values in parentheses are the coated amount.

| | |
|---|---|
| Second Layer | Gelatin (1,000 mg/m$^2$), Silica*2 (30 mg/m$^2$), Film hardening agent*3 (40 mg/m$^2$) |
| First Layer | Silver chlorobromide emulsion (50 mol % bromide, coated wt. 500 mg(Ag)/m$^2$), Sensitizing dye D-1 ($10^{-6}$ mol/m$^2$), Gelatin (1,000 mg/m$^2$), Image forming compound (300 mg/m$^2$), Triisononyl phosphate (200 mg/m$^2$), Suractant*4 (100 mg/m$^2$), 1-Phenyl-5-mercaptotetrazole ($5 \times 10^{-6}$ mol/m$^2$) |
| Support | |

The photosensitive material (G) was exposed in the same way as in Example 1 and then immersed for 1 minute in 0.5M $K_2CCO_3$ solution (adjusted to pH 12.5 with the addition of KOH) which had been heated to 40° C., after which the material was washed with water, and it was then superimposed on a dye fixing material as described in Example 1 in such a way that the film surfaces were in intimate contact. The combination was then heated for 5 seconds on a heated block at 80° C., after which the dye fixing material was peeled apart from the photosensitive material, whereupon a blue positive color image was obtained on the dye fixing material. The maximum density of the color image was 1.80 and the minimum density was 0.14, and excellent discrimination was achieved.

While the invention has been described in detail and with reference to specific embodiments thereof, it will be apparent to one skilled in the art that various changes and modifications can be made therein without departing from the spirit and scope thereof.

What is claimed is:

1. A color photosensitive material comprising a support having thereon a silver halide and a dye releasing compound represented by formula (A):

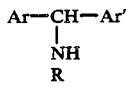

(A)

wherein Ar and Ar', which are electron donating groups able to stabilize the central carbonium ion, and which may be the same or different, each represents an aromatic group or a heterocyclic group, Ar and Ar' may be joined together to form a ring, and R represents an aromatic group, a heterocyclic group or a sulfonyl group.

2. A color photosensitive material as claimed in claim 1, wherein the group represented by RNH in formula (A) is a group which can reduce a developable silver halide; and R contains at least 10 carbon atoms.

3. A color photosensitive material as claimed in claim 1, wherein at least one of Ar and Ar' represents a phenyl group having a di-substituted amino group in the p-position or a substituted indolyl group having a substituent in the 1-position; or Ar and Ar' are joined together to form a xanthene ring or a dihydroacridine ring.

4. A color photosensitive material as claimed in claim 1, wherein the group represented by RNH is represented by one of formulae (I), (II), (III), (IV), (V) and (VI):

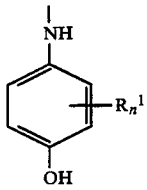

(I)

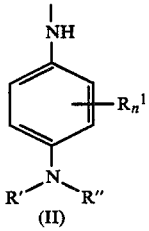

(II)

-continued

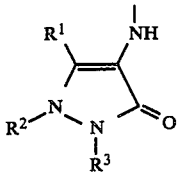

(III)

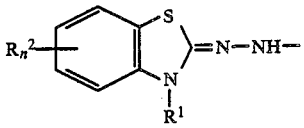

(IV)

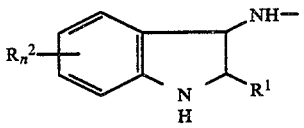

(V)

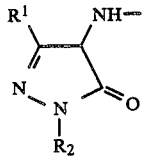

(VI)

wherein R' and R'', which may be the same or different, each represents a substituent selected from the group consisting of a hydrogen atom, an alkyl group, a cycloalkyl group, an aralkyl group and aryl group, which groups may further be substituted; $R^1$, $R^2$ and $R^3$, which may be the same or different, each represents a substituent selected from the group consisting of a hydrogen atom, a hydroxyl group, a halogen atom, a cyano group, an alkyl group, an alkoxy group, a carbamoyl group, a sulfamoyl group, an acylamino group, a sulfonylamino group, a urethane group, a ureido group, an amino group, an acyl group, a sulfonyl group, an aralkyl group, a cycloalkyl group, an aryl group and a heterocyclic group, which groups may further be substituted; n represents an integer of from 0 to 3; and when n is 2 or 3, the groups represented by $R^1$, $R^2$ or $R^3$ may be the same or different 5. A color photosensitive material as claimed in claim 4, wherein at least one of the groups represented by $R^1$, $R^2$ and $R^3$ has at least 8 carbon atoms.

6. A color photosensitive material as claimed in claim 1, wherein said silver halide is a negative silver halide emulsion.

7. A process for producing an image comprising image-wise exposing a color photosensitive material as claimed in claim 1, by developing said material under alkaline conditions to cause oxidation of said dye releasing compound into a structure which does not release a diffusible dye in regions where development has taken place, and subsequently treating said developed material with an acidic compound to cleave the carbon-nitrogen bond of said dye releasing compound in regions where development has not taken place to cause release of a diffusible dye, followed by image-wise transferring said diffusible dye to a dye fixing material.

8. A process as claimed in claim 7, wherein the pKa of said acidic compound is not more than 4.

9. A process as claimed in claim 7, wherein said dye fixing material comprises an anionic polymer.

* * * * *